United States Patent [19]

Rodríguez Urroz et al.

[11] Patent Number: 5,072,682

[45] Date of Patent: Dec. 17, 1991

[54] SAILBOAT WITH A PIVOTED MAST-TO-HULL MOUNTING SYSTEM

[76] Inventors: Augusto C. Rodríguez Urroz, 6990 Montegrande St., 7600 Mar del Plata, Province of Buenos Aires; Daniel M. Nieto, 2055 Hilarión de la Quintana St., 1636 Olivos, Province of Buenos Aires, both of Argentina

[21] Appl. No.: 547,516

[22] Filed: Jul. 3, 1990

[51] Int. Cl.[5] ..... B63B 39/02

[52] U.S. Cl. ..... 114/91; 114/39.001

[58] Field of Search ..... 114/90.89, 91, 124, 114/132, 133, 135, 136, 137, 140, 143

[56] References Cited

U.S. PATENT DOCUMENTS

| | | | |
|---|---|---|---|
| 713,830 | 11/1902 | York | 114/137 |
| 3,324,815 | 6/1967 | Morales | 114/143 X |
| 3,885,512 | 5/1975 | Marcil | 114/91 X |
| 3,972,300 | 8/1976 | Adamski | 114/91 X |
| 4,686,922 | 8/1987 | Burroughs | 114/124 |
| 4,817,550 | 4/1989 | Gutsche | 114/124 |

FOREIGN PATENT DOCUMENTS

| | | | |
|---|---|---|---|
| 37346 | 8/1914 | Sweden | 114/124 |

*Primary Examiner*—Ed Swinehart

[57] ABSTRACT

Substantial improvements in design, cost, performance, safety and comfort could be had in sailboats if the hull were to navigate in a level attitude even under strong wind conditions. This is achieved by the present invention by virtue of the mast pivoting on the hull along a longitudinal axis of the vessel. In this way the wind pressure on the sail generates a forward component and a lateral component, the former being the useful wind force which the mast transmits through the pivot to the hull of the boat to propel it. The lateral component, which in conventional fixed-mast boats causes the hull to list depending on the wind direction and force, is not transmitted by the pivot to the hull but causes the part of the mast holding the sail to tilt leeward about the pivot. In order to counter the lateral wind force the invention further provides a counterweight joined to the bottom part of the mast, below the pivot, to generate a resisting torque which balances the mast at an appropriate angle depending on wind conditions. Preferably, the counterweight is situated underwater and is shaped to hydrodynamically complement the underwater surface of the hull. The conventional keel may be dispensed with or substantially reduced. The invention is also applicable to catamarans wherein the mast may be mounted to pivot in the middle of the structure supporting the pair of hull floats.

8 Claims, 2 Drawing Sheets

SAILBOAT WITH A PIVOTED MAST-TO-HULL MOUNTING SYSTEM

FIELD OF THE INVENTION

The present invention refers to a mounting system for the sail-mast of a wind-propelled vessel, such as a sailboat, a yacht, a sail-buggy, etc. More particularly, the invention refers to a novel form of link between the mast and a vessel of this type, where the propulsion means comprises a sail on the mast attached to the hull on which the vessel floats. Although the present specification makes detailed reference to the application of the present invention to a sailboat, because this is the field where the advantages of this invention are prominent, it is pointed out that the present invention is applicable to any transport means propelled by sail means which collect the force of the wind and transmit it to the vessel.

BACKGROUND OF THE INVENTION

The well-known sailboat has been considered through the ages as an integral unit the main parts of which are the floating means (hull or vessel) and the propelling means (mast and sails).

The methods adopted for designing sailboats precisely consider the same as an integral unit. The analysis thereof has always been highly complex since it was necessary heretofore to simultaneously consider the entire set of interacting factors and variables, thereby requiring huge calculations to determine the appropiate magnitude for each one of them for a specific design. This problem still lasts since the coming of vessels of this type centuries ago in spite of the increase in knowledge of mankind in different scientific subjects related with this topic. The best results are obtained by just a chosen few having innate skill, knack and individual experience who begin with conventional designs which they readjust and retouch until satisfactory results are obtained after a great deal of work.

The design process often involves arriving at "balanced solutions" wherein values for conflicting or divergent variables must be stretched to limits. In addition there inevitably is an excesive range of uncertainty in the final result. Because of this, naval constructors and designers, with the aim of reducing the eventual deviations from the specifications for a new boat, resort to using, as starting point, previous designs having known behaviour. These designs are updated, then lines are readjusted, and proportions and materials are tested to obtain a superior product; however the actual behaviour, qualities or defects are not known until the boat has been launched and tested in water before one can know for sure whether the project is a success or a failure.

It is difficult to study the interactions between the project variables and the practical implications based on tables, scaled models, plans, formulae, charts and calculations to predict the precise behaviour of the project under controlled conditions in an experimental channel. One should remember that practically all studies in an experimental channel are carried out only on the hull of a boat to derive navigavility, floating lines, etc. However, the hull of the boat is always analysed as an independent float; that is, the prototype is not studied together with scaled propulsion means, such as screw propeller, sail or any other such system. This makes the results obtained from studying a wind-impelled floating vessel differ from reality because the actual conditions in which the vessel will sail are variable and very different from those simulated in the experimental field.

An important aspect, for example, are considerations on the water lines which must be defined for a particular vessel and on which most of the chances of success of the boat depend. The design of the water lines, which constitute the loci of the different horizontal planes or flotation planes which together define the final shape of the hull, is even more important in the case of a sail-boat because, as any expert in the art should know, it is in the water lines where the forward travel resistance of the boat lies. Because sail-boats are listed by the wind the water-line or hull profile in contact with the water is not always the same. Hence, it may be said that the final design of the hull is far from ideal or at least not accurate for a certain general resistance. Summarising, the listing or inclination of the boat brings about different and prominently varying geometries of the underwater portion of the hull; therefore the analysis of the forward movement resistance of the hull is complex and an optimum design may not be reached for different speeds. This happens with conventional boats and has not been solved until now. This is why the inclination or listing of a boat is most important.

The consequences of the inclined navigation on the structure of the boat, although some authors consider them less important, are relevant since they generate forces, strains, torques, stresses and torsions which are particular to each condition of inclination, and must be taken into account by a naval designer as factors in his project. In this manner a sailboat project must include all the calculations necessary to achieve an adequate transverse stability both at small and large angles of inclination, apart from the need of an adequate dynamic stability at certain listing angles. This means, in other words, that the boat must be able to absorb certain external energy without listing over more than a certain angle. This is analysed further on with reference to the drawings.

The systematical experimental data for the theoretical determination of the forward resistance, sustentation coeficients, sail resistance, increased resistence in heavy water, etc., are insufficient, hence the theoretical solutions of the boat balance equations are more cualitative than cuantitative and represent no more than simple comparisons between different alternatives. Balanced solutions between fundamental parameters like sail-area, hull/sail-area balance, stability and weight distribution, which are frequently conflicting, are preferably obtained first calculating one parameter and then successively others before recalculating each with successive iterations, because of the strong interrelationship between variables and parameters characterising a wind-propelled vessel of today. This is because a single structural unit has been considered in which all its components act integrally and the designer is integrally unable to consider the propulsion unit, such as the sail, rigs, mast, etc., individually from the floating means (vessel or hull per se) because it was not possible to consider these two important elements separately until now and less still separated both physically and conceptually, for the analysis and project of a transport means such as a sailboat. Works, studies and projects carried out historically in the field of naval navigation have been limited, particularly insofar a sailing vessel is concerned, to the analysis, modification and optimization of hull lines to reduce the forward resistence of a vessel, the sails to take better advantage of the wind forces, the design of the rigging, its operating elements, connections, etc., which have led to a simplification of the typical manoeuvers of a sail-boat, the keels and the rudders. But it may be said that the novelty introduced by the present invention and to which reference is made hereinafter is without precedent in history either in naval navigation as in any other transport means using sails for propulsion, for which reason no particular reference may be made to prior art for making a comparison between the present invention and the state of the art. The advantages of the present invention will immediately appear from an innovation which, as previously stated, is without precedent in history in general and in this field in particular.

SUMMARY OF THE INVENTION

Because of the aforementioned disadvantages we decided to separate the two more important assemblies in a sailboat, which are the sail propulsion assembly and the hull or vessel per se. What is more important, by means of the present invention, not only have these elements been separated for analysis and consideration but they are structural]y separated in a way that each may carry out its specific function without affecting the other by transmitting damaging cross-effects. In short, according to our invention the mast and sails provide the hull only with the purpose for which they are specifically designed and that is for pushing the hull with a force in the forward direction without transmitting detrimental forces which list or incline the hull of conventional yachts. Therefore the hull now does not have to carry out functions for which it should not be designed for like keeping the boat in a level attitude (that is in a straight, erect or vertical condition) since the hull should have as its only purpose that of providing space for load and housing and for navigating, apart from flotation of course. According to the present invention, therefore, the aim of the mast and sail is to propel the boat in the forward direction and the only aim of the hull is to provide room for the crew and load and to navigate in a completely level attitude without being affected by the mast and the sail.

The present invention refers to a mast-sail and hull system, and more particularly to the way the mast is mounted to the hull of the boat by means of which the effect of the propulsion assembly (mast-sail) is separated from that of the floating means (hull or vessel) each of which are restricted to their inherent functions since, by means of the present invention, the propulsion means may only transmit the wind force resulting in the forward direction without transmitting the transversal component or listing moment of the wind force which heretofore has caused conventional sailboats to navigate in an inclined position. In order to achieve this, the present invention provides a mobile mounting between the mast, or propulsion means, and the hull or floating means such that the mast only transmits the forward resultant force to the hull but not the inclining forces. Thus the latter may only be considered on its own, i.e. design considerations may be focussed on navigability problems inherent to a floating means and not related to an integrated unit of the mast and hull as happens with a classical or conventional sailboat. In this way the entire design technique of a sailboat is revolutionized and the propulsion means and the floating means may now be considered as separate parts such that the floating means may be designed according to navigation concepts and then the propulsion means may be designed according to the requirements of wind, speed, etc.. In this way, the naval architect or designer is free from the interdependence and interrelationship of variables and parameters which until now have been fundamentally linked to each other.

The basic principle underlying the present invention could be summarised by saying that it is based on the provision and the combination of a wind force collecting device, that is the sail, a floating means or hull and an articulation point or pivot between the mast of the wind collector system and the hull or vessel.

In short, the present invention provides a sailmast mounting arrangement for a sail-propelled transport, such as a sailboat, wherein the boat includes at least one mast which is fixed to at least one wind collector, or boat propeller sail, said mast comprising a mast part itself to which the sail is fixed and a lower counterweight or counterweight arm, both parts forming an integral unit which is connected to the hull of the boat via a linkage longitudinal axis which coincides with the medium longitudinal plane of the boat and forms a pivot having angular movement between the mast and the hull around said linkage axis, said counterweight arm being located below said linkage axis.

In the case that the present boat has a conventional hull design, the medium longitudinal plane may preferably be the longitudinal symmetry plane. If the invention is to apply to a catamaran or trimaran, said plane will be a symmetry plane or some other longitudinal plane which passes nearest the middle of the boat or is in a position that the level attitude of the board is not affected.

From the foregoing it may be seen that the propulsion part, to which reference has been previously made, comprises a mast part and a counterweight part or arm, both of which are defined on either side, above and below, of a linkage point through which this unit is fixed to the floating means or vessel itself.

The propulsion means may be articulated to the hull in said longitudinal linkage axis, preferably at a height coincident with the water plane, however this link point could be higher or lower. Thus for example it could be mounted at the deck of the hull or else on the keel at the bottom part.

In a preferred embodiment, the mast part itself and the counterweight part may comprise a single piece or bar which in its mast-part carries the corresponding sail and in its lower part carries a counterweight member which may comprise a body, ballast or weight, such as iron for example. This counterweight member may have a hydrodinamic shape or the counterweight part may directly be the keel of the boat. In this way the keel is directly integrated with the mast of the boat to act as counterweight for the tilting mast of the present invention.

As another feasible combination according to the present invention the keel of the boat may be a conventional one, fixed to the hull of the boat, and be provided with a vertical groove-like section within which the counterweight extends. This counterweight arm extending along this vertical section may include said counterweight member which may furthermore be shaped to complement the profile of the keel of the vessel.

It is also important to point out that the present invention is applicable to catamarans, trimarans and other types of sailing vessels. The propulsion means in the case of the catamaran pivots on the junction structure of the catamaran floaters without risking the mast or the counterweight arm touching the floaters or structures when undergoing angular movement.

DETAILED DESCRIPTION OF THE DRAWINGS

Figure 1:
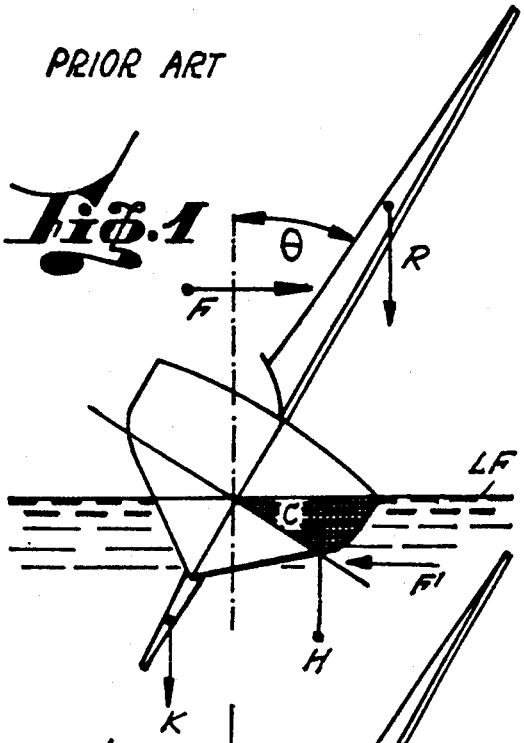
PRIOR ART Fig. 1
FIG. 1 schematically illustrates the cross-section of a conventional sailboat situated in a listed position and showing the forces that interact to alternatively incline and level the boat.

In order to more clearly understand the advantages of the present invention reference is made hereinafter to FIG. 1 in analysing the phenomena involved in a conventional sailboat.

Reference was previously made to the importance of the dynamic stability at different inclination angles, which is a requirement which must be satisfied by keeping this stability factor within certain ranges specified for different types of sail-boats, according to theory and experience.

The speed of the wind which exerts pressure on the sail has the effect of a force F applied to the centre of the sail surface which is called the sail centre. The force F multiplied by the distance between the sail centre and the drift centre forms what is called a listing moment or torque since it evidently tries to incline the sailboat. As it is well known in the art said distance and the force F decrease when the boat lists at an angle Θ under the effect of said moment and therefore no more specific reference is made to this phenomenon herein. On the other hand, the boat reacts generating a torque called the trimming moment or straightening torque which tends to put the boat in a level attitude.

By establishing the equations on transversal stability of a sailboat and taking into account the affected parameters, we get that the pushing action of the sails plus the wind force on the deadwork, the latter being the entire part of the hull above the waterline or water level, is equal to the holding force generated by the hull, the rudder and the keel. Equating:

$$M_s = M_h + M_k - M_r$$

where:

$M_s$: is the listing torque produced by the wind action on the sails;

$M_h$: is the straightening torque produced by the side of the hull under water during listing of the boat;

$M_k$: is the straightening torque applied by the keel of a conventional sailboat;

$M_r$: is the torque caused by the weight of the mast and the sails due to the inclination of the boat and which is also a listing torque.

The straightening moment $M_h$ of the hull is that contributed by the wedge C (see FIG. 1) which is the lateral volume submerged when the boat lists and causes an upperly directed push generated by the water on the starboard side of the hull, as seen in the figure, thus generating a leeward force H directed upward which tends to straighten the sailboat. Consequently the greater the volume of the immersed wedge C, the greater the force H trying to straighten the boat. For this reason, conventional sail-boats are relatively wide but this is detrimental to the speed of the yacht. In addition to the moment $M_h$ there is a moment $M_k$ generated by the weight of the keel directing a force K downward which also tends to straighten the sailboat. Furthermore, a negative force R, due to the weight of the mast, rigging and other components, produces a moment or torque $M_r$ which adds to the listing effect of the force F of the wind which generates the moment $M_s$.

As may be seen from here on and in relation to the drawings illustrating the present invention, the arrangement of the mast of the present invention keeps the sailboat from listing and therefore it becomes unnecessary to consider the straightening force H developed by the submerged wedge C. Since the sailboat of the present invention does not list, it need not be as wide as was necessary heretofore to contribute the force H and therefore it may have a narrower beam (breadth) and so develop a higher speed regarding any equivalent conventional sailboat.

Continuing on the drawbacks of a conventional sailboat it may be seen in FIG. 1 that the leeward area of the port side (left side of the figure), is more exposed (out of water) than starboard originating a greater push of the wind on the boat towards the starboard or leeward. Since the hull of the sailboat of the present invention does not list as a result of the force of the wind on the sail, its freeboard, that is its emergent side area, is constant and therefore does not suffer the effects of the wind as the leeward emerged part of a conventional sailboat.

Different embodiments are schematically illustrated in FIGS. 2 to 6, referring to the mounting arrangement of the mast and sail of a sailboat according to the present invention. In these figures, the same reference numbers are used for common elements. A hull 1 is illustrated in each case as floating on the water according to a water line LF and provided with a propulsion means 2 according to the present invention, which means 2 is shown inclined at an angle Θ which has been chosen as aproximately 30° for explanatory purposes. The propulsion means 2 comprises a mast 3 and a counterweight part or arm 4. In the preferred embodiment, the latter comprises a single piece or rigid bar pivoted on the hull according to an axis 5, embodied as a shaft fixed to the hull, preferably a horizontal shaft; however said axis could otherwise be adapted to shift to change the inclination of the mast in the longitudinal direction.

Figure 2:
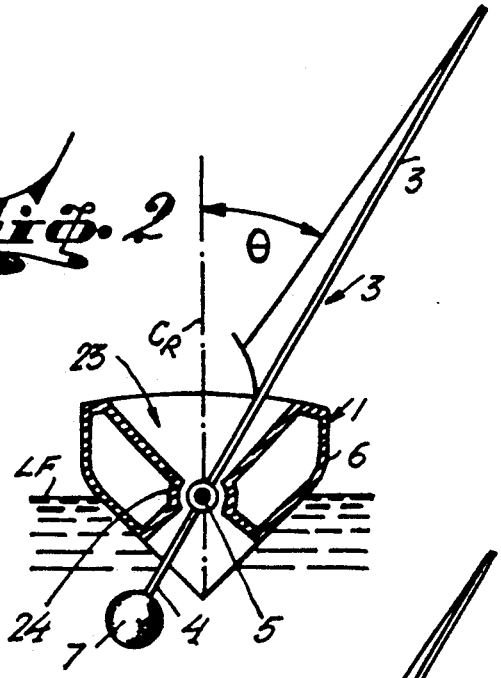
FIGS. 2, 3 and 4 are schematical section views of different embodiments of yachts according to the present invention.
Figure 3:
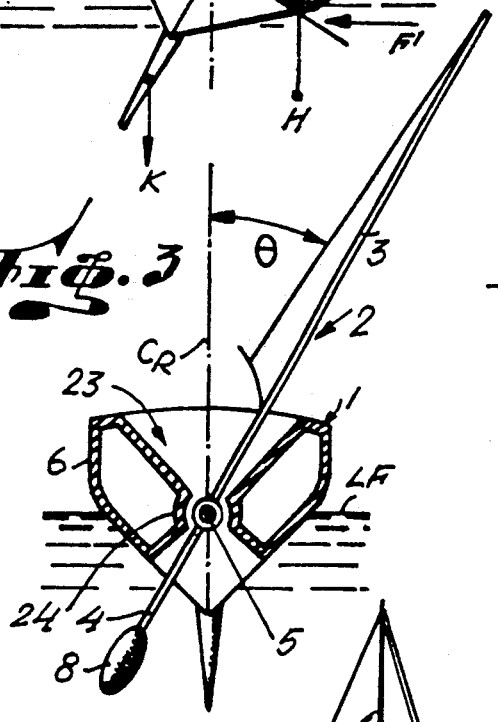
Figure 4:
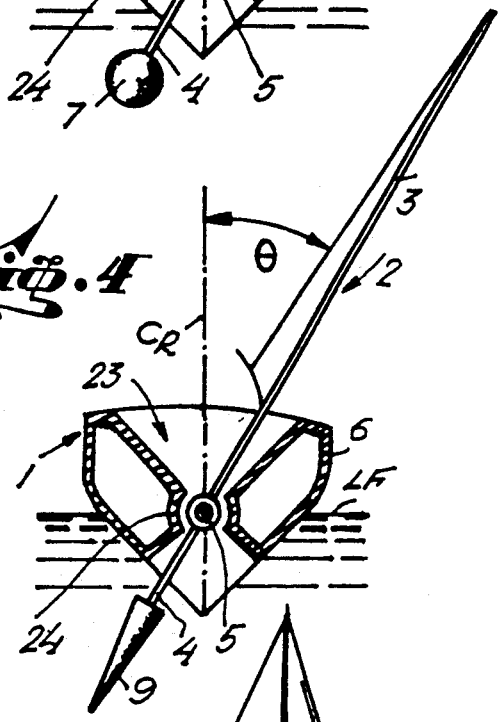

The hull is illustrated in the FIGS. 2, 3 and 4 from a frontal view and according to a cross-section passing through the section of the same which cuts the axis 5 and contains the linkage region of the mast 3 and the counterweight arm 4. In order to enable the mast 3 to pivot, the hull provides a section which, in a front view, looks like two trapezoids opposed by one of their corners 24, which corners 24 tend to coincide with and preferably surround the axis 5. The trapezoids 6 form part of the wall of the hull in the linkage and mounting zone of the axis 5, but they may obviously have any other shape according to the design of the space 23 which provides passage for the mast 3 and the counterweight arm 4. This passage must be dimensioned to allow tilting of the propulsion means 2 along the angles for which the sailboat was designed.

The compensating part or arm 4 may have any adequate shape and in FIG. 2 it is shown as a bar which extends the length of the mast 3 downward and which at its lower end has a weight or counterweight 7 like a ball heavy enough to generate a straightening torque on the mast 3.

In FIG. 4 the counterweight comprises the keel 9 of the vessel fixed to the counterweight arm 4 which forms part of the propulsion means 2. In this embodiment then the keel is independent of the hull 1 and performs a counterweight function to straighten the mast 3.

Figure 5:
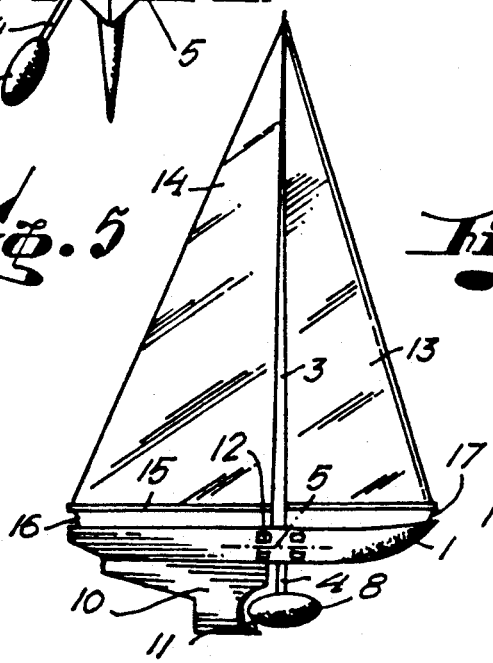
FIGS. 5 and 6 are schematical side views of sail-boats embodying the present invention.

A combination of a counterweight 8 on the propulsion means 2 of the present invention with a fixed keel of a conventional vessel may be seen in FIG. 3. This combination maintains a constant drift plane given by the lateral projection of the total hull and keel area, and in this case the invention may be embodied as illustrated by the side views of FIGS. 5 and 6. In these embodiments the propulsion means 2 and more particularly the counterweight arm 4 includes a bulb 8 on its lower end and this bulb is shaped complementary to the geometry of the fixed keel 10. In this way and as illustrated in FIG. 5 the counterweight arm 4 with its bulb 8 may be situated fore of the keel 10. To accomodate this bulb, the keel is provided with a recess 11 in order to define together with the bulb 8 an optimum hydrodynamic profile.

Figure 6:
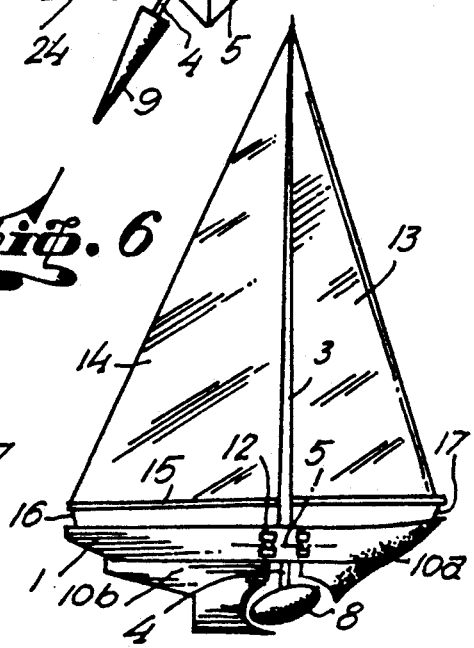

FIG. 6 illustrates another embodiment of the type shown in FIG. 3 in which the bulb 8 and the counterweight arm 4 are located in a recessed section of the keel 10 which is formed by a first fore part 10*a* and a second aft part 10*b*.

The assembly formed by the mast 3 and the counterweight arm 4, schematically shown in FIGS. 5 and 6, is arranged on an axis 5 which in turn is fixed to the hull by means of any suitable structure, having for example bearings 12 of any known type, such as ball-bearings, roller-bearings, etc, as long as they are suitable for their purpose in the present invention.

The fore sail or jib 13, the main sail 14 and the boom 15 to which the main sail 14 is affixed are illustrated in FIG. 6. The fittings of the sails 13 and 14 on the hull 1 are embodied by means enabling the same to be adjusted when the mast 3 tilts or leans over in order to expose the best sail area to the wind. For this reason the boom 15 is fixed to a regulator rig 16, such as a fore sheet, and the jib is fixed to a rig 17 such as a jib downhaul. These rigs are preferably joined at the height of the axis 5 so as not to introduce variations in the angles which the sails offer to the wind. If the rigs or chords 16 and 17 must be fixed to the deck, at points that is higher than the level of axis 5, conventional regulator means may be installed.

Figure 7:
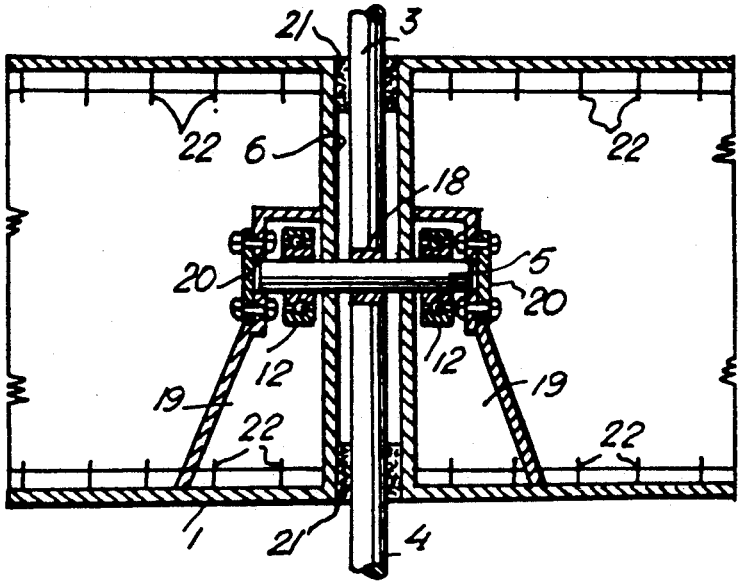
FIG. 7 is a section view of a sector of the hull where the mast and corresponding counterweight are mounted according to the present invention.
Figure 8:
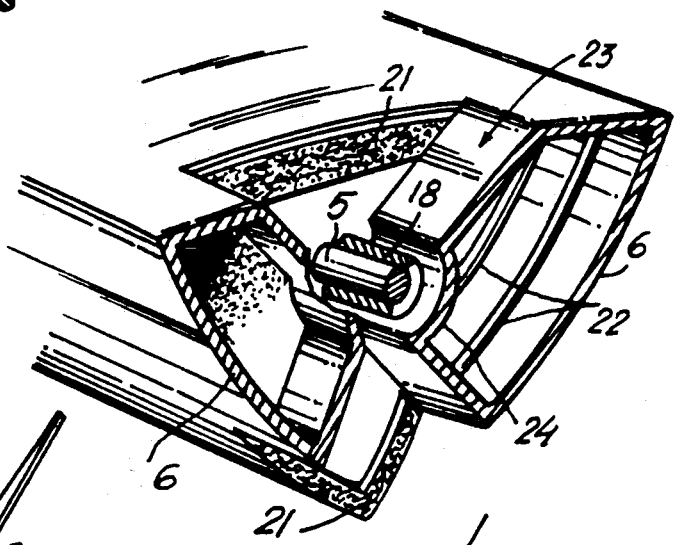
FIG. 8 is a perspective and section view of the portion of a sailboat hull showing its structure enabling the mounting of mast and counterweight according to the present invention.

The mast 3 may be connected to the hull 1 at the axis 5 using a broad number of alternatives, the structures shown in detail in FIGS. 7 and 8 are given simply by way of example. A longitudinal section of the hull 1, in FIG. 7, shows transversal structure bars 22, such as ribs or floor plates, which may be of any type commonly used to make the hull of a vessel of this type. As may be seen in FIG. 8 the angled opening 23 houses the mast 3 and the counterweight arm 4 such that they can pivot when subjected to angular movement by the wind. The mast 3 may be mounted on a bearing or bushing 18 of any known type which lets the mast 3 pivot on the axis 5 with minimum friction. To additionally reduce friction between the parts shaft 5 may be mounted on the structure of the hull 1 by means of the bearings 12. These bearings 12 may be mounted on some supporting structure which in the illustrated embodiment is comprised by triangular plates 19 properly fixed to the structure and frame of the vessel. The axis 5, which as stated above is a shaft, may be conveniently closed by end-lids 20 mounted onto the plates 19.

A perspective view in FIG. 8 shows a cross-section of the zone where the axis 5 is situated and where the mast 3 and the counterweight arm 4 pivot. Just for reasons of clarity the drawing omits the assembly formed by the mast 3 and the counterweight arm 4 and only shows the linkage opening 23 so that the pivot axis 5 and the bearing means 18 may be seen. The fore and aft walls of the linkage opening 23 may be provided with good antifriction materials or antifriction pads 21 which receive the force of the wind transmitted in the longitudinal direction, that is the force which drives the vessel forward, and at the same time permits angular movement of the propulsion means with the least possible friction.

It can be seen clearly in FIG. 8 that the vessel is water-tight since the linkage opening 23, in spite of forming a through passage from the main deck down to the keel of the vessel, is completely shut off from the inside of the vessel such that the floatability of the boat is not impaired.

Although in this embodiment the passage from stern to bow of the boat is blocked by the mast mounting structure consisting of the linkage opening 23 and the trapezoids 6, the sides of the vessel have sufficient room towards the bow zone for passage of the crew or for arranging suitable litters as in conventional vessels.

Figure 9:
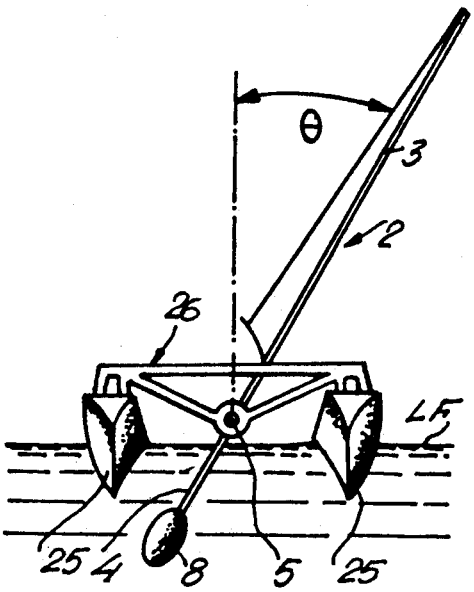
FIG. 9 is a front view of a catamaran embodying the present invention.

Since the vessel may be a catamaran as mentioned beforehand, as may be seen in FIG. 9 the invention is also applicable to a catamaran comprised by floaters 25 joined by a structure 26 including an axis 5 on which the propulsion unit 2 pivots. The trapezoids 6 may comprise the catamaran floater sections and the rest of the hull may simply be a resistant cover to complete the section and give a single-hulled boat aspect. The bottom part of the cover may furthermore form a tunnel for conveying advantageous hydrodynamic or aerodynamic effects. The arm 4 is also provided with a counterweight such as the one identified by reference number 8. It is a foregone conclusion that the counterweight arm may have any shape, either in the catamaran as in the other applications; however since there is much more room avaiblable in the catamaran between the floaters 25, the counterweight arm 4 and the counterweight 8 may be shaped differently from what is illustrated.

Having made reference at least generically to the basic and preferred arrangements of the illustrated embodiment of the present invention, reference is now made to the operation and to some particular details which has appeared to be important and the advantages fulfilled by putting the present invention into practice.

The wind collector basically comprises the mast 3 and the sails 13 and 14 which as usual generate a listing or inclinating torque or moment, however this moment is counteracted by a straightening torque generated by the counterweight part or arm 4 and the counterweight 8, where the straightening torque is in the opposite direction to the listing torque to stop excesive inclination of the mast 3 and place it in a straight or vertical position. In this way the resultant force of the wind pressure generates a listing torque which is counteracted without affecting the stability of the hull, while the wind resultant which causes the forward movement of the vessel is applied without any obstacule on the hull causing it to advance. Hence advantage is taken of the useful wind force component and at the same time the undesirable component, which is a hindrance for conventional vessels, is cancelled. In conclusion the mast and sails do not transmit the detrimental forces which list the hull.

Thus the aforementioned variables are independent from one another and a great many "balanced solutions" are avoided, one of the consequences of the present invention being the elimination of design restrictions, both in the propulsion means and in the floating means, to open up a new field and scope for the analysis of the delicate balance of strengths and forces, and its consequences in design and navigavility. From the aforementioned it may be reasoned that one of the biggest advantages of this invention is that it avoids the boat listing and even the danger of capsizing when the sail mast inclines under the wind action. For the cases in which the vessels have more than one mast each may act independently from the rest. Also the sails may be arranged without sidestays and its components which would bar the angular sweep of the mast, whilst the rest of the components are kept. This avoids the stresses which are transmitted conventionally via the sidestays to the hull structure.

In the case where the counterweight is formed by the counterweight arm and the counterweight itself is combined with the keel of the boat as is illustrated in FIGS. 3, 5 and 6, it is not necessary for the keel to carry out the double function of providing a counterweight and providing a drift plane, so that the keel will only carry out the function of providing an additional drift plane (and a directional plane). Thus the location, shape and size may be reconsidered without restrictions which until now were conditioned in a fixed-mast boat needs to cause enough water-desplacement to generate the straightening torque together with the hull which counteracts the listing action. The great advantage of the drift plane calculated and projected for a pivoted-mast boat is that the designed plane does not change during navigation due to inclination caused by the wind so that the drift plane and functionality is maintained as projected. This does not happen with a fixed-mast boat where the lateral projection of the drift plane reduces with boat inclination (see FIG. 1). The counterweight 7, 8 or 9 is joined to the mast by means of a counterweight part or counterweight arm 4 the length of which may vary according to the force torque required by the project specifications, since the weight of the counterweight 7, 8 or 9 multipled by the length of the counterweight arm 4 establishes a torque which balances the torque produced by the sails. The length of the counterweight arm and the weight of the counterweight are determined from the project specifications taking into account restricting condictions of maximum water displacement on one hand and the torque requirements needed for balancing the sail means on the other. The length of the counterweight arm may be variable in a way that the arm telescopes on the mast or forms an equivalent assembly with adequate locking means so that the counterweight 4 to be lifted or lowered.

Because the propulsion means is a dynamically balanced functional unit it maintains, for the selected area of sail, the propulsion force which results from a constant-intensity sail action, automatically changing the angles of inclination of the mast according to the actual outside conditions and what is required of the boat at that moment. Manoeuvers and tasks on the sails (in respect of height, type and tension) which are required in fixed-mast boat to scale down listing angles (greater than 120°) are also avoided.

When the wind resultant force on the sail centre exerts a force or torque (listing torque) that is greater than the torque of the counterweight (straightening torque) the mast will start to incline without listing the yacht. This enables the mast to reach greater angles of inclination without any inconvenience to the boat, approximately 120°, that is 30° past the vertical. In conventional fixed-mast boats it becomes necessary at less listing angles to alter course or lower the sails (reduce the sail area) to reduce the stress torque (listing torque) and the listing. These bigger angles are considered by the specialists as limit inclinations or sink angles. Under the same conditions, with the movable mast of the present invention angles of 150° or more, that is over 60° past the vertical, may be reached for a similar boat in the same conditions. That is, with strong winds or limit conditions the inclination of the mast with respect to the vessel will regulate automatically without listing the boat. So the present invention not only allows the course to be maintained but also the same sails or sail area may be kept without any difficulty arising from listing nor any peril of sinking.

The advantages regarding manoeuvrability of a normally levelled hull, in comparison with an inclined hull, are logical and well known since the rudders and other structures and elements have a normal position in the water and the flotation line remains perpendicular to the symmetry plane and shapes of the project. This is an advantage never seen in comparison with conditions of little manoeuvrability which an inclined rudder imposes, including an irregular wet area (turbulent water of lesser density). It should also be pointed out that the drawbacks regarding manoeuvrability make the boat lose speed.

The listing action in conventional sailboats makes the hull expose a bigger area to the wind and this causes the boat to drift sideways. This is further compounded because the greater the inclination the lesser the drift plane as stated previously. When the drift plane is reduced regarding the original projections the boat offers less resistance to lateral movement of the hull (lateral displacement effect of the boat).

The greater the inclination angle the stronger the above phenomena. If the boat is embodied according to the present invention, that is with a pivoting mast, under the stated conditions the boat will not be subjected to any of these inconveniences, risk and other problems to which a yacht heretofore was exposed but :t will keep its navigability, it will not need to alter course due to exposure of the listed hull nor will the drift plane of the keel reduce to keep the vessel in its normal position, so the yacht may maintain its speed. Because a sailboat provided with a pivoting mast does not need any sidestays for the mast nor any crosstress (cross-pieces) it has better aerodynamic features. These structures offer in conventional yachts an aerodynamic resistance, a restriction on forward speed and lateral aerodynamic resistances, the force components of which, apart from the torque generated by the weight itself of the components of these elements, contribute to the stress torque of the sail plane.

As to the freeboard, that is the height of the hull above the water-line, its structural dimensions have been established and calculated in conventional boats to allow for navigation with an inclined boat. However this factor has advantages and drawbacks which are taken into account in the rules of the I.O.R. on the basis of their extensive experience in this matter. These rules establish that the freeboard has a direct relationship with the length of flotation and is obtained by multiplying the value given to the flotation length LWL, expressed in meters, by a coefficient equal to 0.057, and adding a value of 0.366 to the result.

$$FB=0.057\times LWL+0.366$$

is the value obtained to try to compensate advantages and disadvantages of the freeboard.

On the other hand a sailboat having a pivoting mast like the one of the present invention may be advantageously designed with lower freeboard values than those indicated in the preceding formula, reducing the angled wind resistance, lowering the centre of gravity, increasing stability and reducing the alteration of the longitudinal balance of the boat which occurs under strong winds due to offset of the application of forces on the deadwork.

In addition to reducing the freeboard because the hull does not list, another advantage is the reduction of the beam, which is of great importance in the project and development of a sailboat specially for competition where a better balance between the variables is necessary to achieve main objectives like navigavility and speed. This is accomplished because the beam does not participate in the dynamic balance of the boat, that is it does not compensate any wind force torque action (task conditions, navigation). Thus the beam has no relation with the listing and the boat may be projected with lines and shapes where the balance bet ween variables and magnitudes is different and much more advantageous that in the case of a fixed (stationary) mast, so that idealer conditions may be obtained for the yacht since less variables must be taken into account in solving the problems leading to a reduction in the balance solutions refered to previously.

In addition to the foregoing the following table establishes a comparison between the advantages of the present invention in relation to what is known in the art.

TABLE

| FACTORS | PIVOTED MAST | FIXED MAST |
|---|---|---|
| Stability | Wind does not list the hull | Wind lists the entire boat |
| Speed | The symmetry of the hull wet surface is maintained so speed is constant. | Symmetry of the hull's wet surface is altered, so speed is reduced. |
| Navigability | Hull, rudder and accessories do not list. | Hull, rudder and accessories list, so their different positions are not ideal and may not all be taken into account during the design. |
| Safety | Sink and man overboard risks are practically eliminated | Man overboard and sink risks are very high; equipment |

TABLE-continued

| FACTORS | PIVOTED MAST | FIXED MAST |
|---|---|---|
| | Equipment damage is also diminished | damage is frequent. |
| Beam | Can be narrower | Cannot be diminished. |
| Crew | Smaller than usual. Extra crew is not needed for counterbalancing purposes. | Large number of members to counterbalance and manage tasks and sail changes. |
| Freeboard | Smaller than specified by I.O.R. rules | Governed by I.O.R. rules. |
| Underwater body | Water lines kept constant. | Water lines are affected by the interacting variables. |
| Drifting | Hull area exposed to wind is constant. The natural drifting angle is maintained. | Hull area exposed to wind increases; therefore so does drifting. |
| Rigging | Shrouds and cross-pieces are eliminated, so weight and aerodynamic resistance decrease. | Excessive rigging increases resistance and weight. |
| Working | Less work. | Classic task. |

We claim:

1. Improvements in a sailboat including a hull defining an interior, at least a main deck, a bottom and a bow zone, the improvements comprising a sail-mast assembly including a mast part per se adapted for supporting at least one sail for propelling the sailboat, and a lower elongated arm having at its lower end a counterweight member defining a hydrodynamic bulb shape, pivot means linking said sail-mast assembly to the hull to enable relative angular movements between the sail-mast assembly and the hull about a longitudinal axis of the hull, in order that said counterweight member may produce a countertorque opposing the force generated by the wind against the sail-mast assembly, a section of the hull, in the region of said pivot means, forming a through passage from the main deck of the sailboat down to the bottom of the sailboat, the interior of the sailboat being a water-tight around said passage and the hull having respective walls surrounding the passage from the main deck to the bottom of the sailboat, these walls defining lateral passages in the interior of the sailboat to communicate the bow zone with the rest of the interior, the pivot means being mounted on a fore wall and on an aft wall of said walls that surround said through passage.

2. Improvements according to claim 1, wherein said lateral passages have trapezoid sections and both lateral passages are opposed by one of their corners, which corners surround said pivot means.

3. Improvements according to claim 1, wherein said longitudinal axis coincides with the middle longitudinal plane of the sailboat.

4. A system according to claim 3, wherein said longitudinal axis coincides with the intersect of said longitudinal middle plane and a horizontal plane of the transport extending between the main deck plane and the bottom or keel plane of said transport.

5. Improvements according to claim 1, wherein said middle longitudinal plane is a plane of symmetry of the sailboat.

6. Improvements according to claim 1, wherein said mast part and said arm are integrated in a single unit provided with said counterweight member at its lower end.

7. Improvements according to claim 6, wherein said sailboat has a keel and said counterweight member has a shape complementing the profile of the keel of the sailboat, the counterweight member and the keel forming independent assemblies, but the keel and the counterweight defining together a substantially continuous hydrodynamic profile when the mast is vertical.

8. Improvements according to claim 6, wherein said sailboat has a keel and said arm and said counterweight member have a shape adapted for location in and complemented by a recessed section in said keel.

* * * * *